US010714072B1

(12) United States Patent
Bodon et al.

(10) Patent No.: US 10,714,072 B1
(45) Date of Patent: Jul. 14, 2020

(54) ON-DEMAND ADAPTIVE ACTIVE NOISE CANCELLATION

(71) Applicant: Cirrus Logic International Semiconductor Ltd., Edinburgh (GB)

(72) Inventors: K. Joshua Bodon, Austin, TX (US); Jon D. Hendrix, Wimberley, TX (US); Brian Thornock, Pflugerville, TX (US); Aaron Treptow, Austin, TX (US); Shahram Tadayon, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/546,130

(22) Filed: Aug. 20, 2019

Related U.S. Application Data

(60) Provisional application No. 62/827,428, filed on Apr. 1, 2019.

(51) Int. Cl.
*G10K 11/178* (2006.01)
*H04R 1/10* (2006.01)

(52) U.S. Cl.
CPC .. *G10K 11/17854* (2018.01); *G10K 11/17881* (2018.01); *H04R 1/1083* (2013.01); *G10K 2210/1081* (2013.01); *G10K 2210/1082* (2013.01); *G10K 2210/3226* (2013.01)

(58) Field of Classification Search
None
See application file for complete search history.

(56) References Cited

U.S. PATENT DOCUMENTS 9,142,207 B2 9/2015 Hendrix et al.
2019/0028803 A1* 1/2019 Benattar ..... H04S 7/304

* cited by examiner

*Primary Examiner* — Kenny H Truong
(74) *Attorney, Agent, or Firm* — Jackson Walker L.L.P.

(57) ABSTRACT

A method may include receiving a user trigger signal indicating a user desire to update characteristics of an adaptive filter, receiving an error microphone signal indicative of the output of the transducer and the ambient audio sounds at the transducer, wherein the transducer reproduces both a source audio signal for playback to a listener and an anti-noise signal for countering the effects of ambient audio sounds in an acoustic output of the transducer, implementing the adaptive filter having a response that generates the anti-noise signal to reduce the presence of the ambient audio sounds in the error microphone signal, determining an acoustic coupling of the transducer to an error microphone for producing the error microphone signal, and responsive to a change in the acoustic coupling, prompting a user to assert the user trigger signal to indicate user desire to update characteristics of the adaptive filter.

28 Claims, 9 Drawing Sheets

ON-DEMAND ADAPTIVE ACTIVE NOISE CANCELLATION

FIELD OF DISCLOSURE

The present disclosure relates in general to adaptive noise cancellation in connection with an acoustic transducer, and more particularly, to providing on-demand adaptive active noise cancellation.

BACKGROUND

Wireless telephones, such as mobile/cellular telephones, cordless telephones, and other consumer audio devices, such as mp3 players, are in widespread use. Performance of such devices with respect to intelligibility may be improved by providing noise cancelling using a microphone to measure ambient acoustic events and then using signal processing to insert an anti-noise signal into the output of the device to cancel the ambient acoustic events.

An active noise cancellation (ANC) system achieves the suppression of noise by observing the ambient noise with one or more microphones and processing the noise signal with filters to generate an anti-noise signal, which is then played through a loudspeaker. The application of active noise cancellation to personal audio devices such as wireless telephones and headphones is intended to enhance the users' listening experience with respect to intelligibility and isolation from the ambient noise. Because the acoustic environment around personal audio devices may change depending on the noise sources that are present and the position or fitting condition of the device itself, an active noise cancellation system may be implemented with adaptive filters in order to adapt the anti-noise to take such environmental changes into account.

A stereo headset that provides active noise cancellation to a user may not always provide maximum ambient noise attenuation. Such scenario may be due to a number of reasons, including but not limited to, a fit of the headset to a user's ears, spectral content of the ambient noise, and manufacturing variations of transducer response. A fully adaptive ANC system may compensate for these factors to some extent by utilizing the user selected playback as a training signal to adjust ANC filters. Because the system has no control over what the training signal provided by the user will be, including volume level and spectral content, precautions must be taken by the system to ensure stable adaptation of the ANC filters. Consequently, a fully-adaptive system only allows adaptation during optimal conditions with the wearer having no knowledge of adaptation status. As a result, some systems exist which provide a forced adaptation option to the user which uses a preprogrammed training signal to adjust filter coefficients and/or filter gains. However, such forced adaptation is generally fixed based on what has been pre-programmed Forced adaptation may result in misadapted ANC filters and cause a negative experience for the user.

U.S. Pat. No. 9,142,207 (the "'207 Patent"), which is incorporated by reference in its entirety, contemplates that adaptive ANC systems may require protection against misadaptation. The protection contemplated in the '207 Patent involves identification of ambient noise or ambient events that are likely to cause the ANC system, upon adaptation while such signals are present, to generate undesirable anti-noise. In the '207 Patent, the adaptive ANC system disclosed therein is continuously adaptive, seizing all potential opportunities for adaptation in order to provide the most desirable antinoise to the listener's ears at all times. The underlying strategy of such a system is to continuously adapt, except when ambient conditions and events might cause adaptation to lead to undesirable antinoise. However, one cost of such a continuously adaptive system is battery drain—adaptation requires significantly more power than merely providing an ANC effect with a fixed (non-adaptive) antinoise filter.

SUMMARY

In accordance with the teachings of the present disclosure, certain disadvantages and problems associated with existing approaches to adaptive noise cancellation may be reduced or eliminated.

In accordance with embodiments of the present disclosure, an integrated circuit for implementing at least a portion of a personal audio device may include an output for providing a signal to a transducer including both a source audio signal for playback to a listener and an anti-noise signal for countering the effects of ambient audio sounds in an acoustic output of the transducer, a user trigger input for receiving a user trigger signal indicating a user desire to update characteristics of an adaptive filter, an error microphone input for receiving an error microphone signal indicative of the output of the transducer and the ambient audio sounds at the transducer, and a processing circuit. The processing circuit may be configured to implement the adaptive filter having a response that generates the anti-noise signal to reduce the presence of the ambient audio sounds in the error microphone signal, responsive to receiving the user trigger signal, determine if undesirable ambient conditions exist such that updating characteristics of the adaptive filter in the presence of the undesirable ambient conditions would lead to the anti-noise signal having undesirable characteristics, responsive to determining a presence of undesirable ambient conditions such that updating characteristics of the adaptive filter in the presence of the undesirable ambient conditions would lead to the anti-noise signal having undesirable characteristics, prevent updating characteristics of the adaptive filter, and responsive to determining an absence of the undesirable ambient conditions, update characteristics of the adaptive filter.

In accordance with these and other embodiments of the present disclosure, an integrated circuit for implementing at least a portion of a personal audio device may include an output for providing a signal to a transducer including both a source audio signal for playback to a listener and an anti-noise signal for countering the effects of ambient audio sounds in an acoustic output of the transducer, a user trigger input for receiving a user trigger signal indicating a user desire to update characteristics of an adaptive filter, an error microphone input for receiving an error microphone signal indicative of the output of the transducer and the ambient audio sounds at the transducer, and a processing circuit. The processing circuit may be configured to implement the adaptive filter having a response that generates the anti-noise signal to reduce the presence of the ambient audio sounds in the error microphone signal, determine an acoustic coupling of the transducer to an error microphone for producing the error microphone signal, and responsive to a change in the acoustic coupling, prompt a user to assert the user trigger signal to indicate user desire to update characteristics of the adaptive filter.

In accordance with these and other embodiments of the present disclosure, a method may include receiving a user trigger signal indicating a user desire to update characteristics of an adaptive filter, receiving an error microphone signal indicative of the output of a transducer and the ambient audio sounds at the transducer, wherein the transducer reproduces both a source audio signal for playback to a listener and an anti-noise signal for countering the effects of ambient audio sounds in an acoustic output of the transducer, implementing the adaptive filter having a response that generates the anti-noise signal to reduce the presence of the ambient audio sounds in the error microphone signal, responsive to receiving the user trigger signal, determining if undesirable ambient conditions exist such that updating characteristics of the adaptive filter in the presence of the undesirable ambient conditions would lead to the anti-noise signal having undesirable characteristics, responsive to determining a presence of undesirable ambient conditions such that updating characteristics of the adaptive filter in the presence of the undesirable ambient conditions would lead to the anti-noise signal having undesirable characteristics, preventing updating characteristics of the adaptive filter, and responsive to determining an absence of the undesirable ambient conditions, updating characteristics of the adaptive filter.

In accordance with these and other embodiments of the present disclosure, a method may include receiving a user trigger signal indicating a user desire to update characteristics of an adaptive filter, receiving an error microphone signal indicative of the output of the transducer and the ambient audio sounds at the transducer, wherein the transducer reproduces both a source audio signal for playback to a listener and an anti-noise signal for countering the effects of ambient audio sounds in an acoustic output of the transducer, implementing the adaptive filter having a response that generates the anti-noise signal to reduce the presence of the ambient audio sounds in the error microphone signal, determining an acoustic coupling of the transducer to an error microphone for producing the error microphone signal, and responsive to a change in the acoustic coupling, prompting a user to assert the user trigger signal to indicate user desire to update characteristics of the adaptive filter.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise cancelling techniques and circuits that may be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electroacoustic path from the output of the processing circuit through the transducer.

Methods and systems in accordance with the present disclosure may rely on a user-triggered preprogrammed training signal to provide an adequate signal-to-noise ratio across the audio spectrum regardless of any ambient condition or user interaction, including but not limited to, acoustic impulses, low-ambient noise level, tones present, speech from the user, wind, and one or both sides of the stereo headset not being worn by the user. An on-demand adaptive ANC system as disclosed herein may use a preselected training signal to optimally adjust the ANC filter coefficients while also providing protection against any disturbances, such as those set forth above that may occur during the training period. Additionally, such on-demand adaptive ANC system may inform a user of a successful or unsuccessful training session through a mobile application and in an unsuccessful case, may advise the user of what the user may do to achieve a successful filter optimizing session. Further, such on-demand adaptive ANC system may analyze a surrounding ambient acoustic environment as well as a fit of the headset on the user and provide a prompt to start the adaptation sequence when improved ANC performance may be achieved.

Figure 1A:
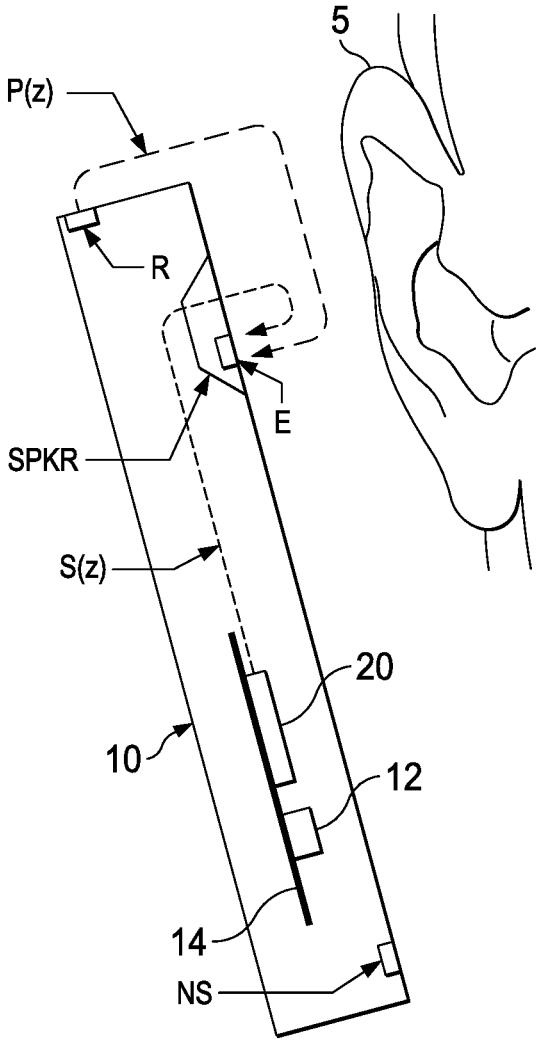
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of this disclosure may be employed, but it is understood that not all of the elements or configurations embodied in illustrated wireless telephone 10, or in the circuits depicted in subsequent illustrations, are required in order to practice the systems and methods recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure include measuring ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of embodiments of the present disclosure may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
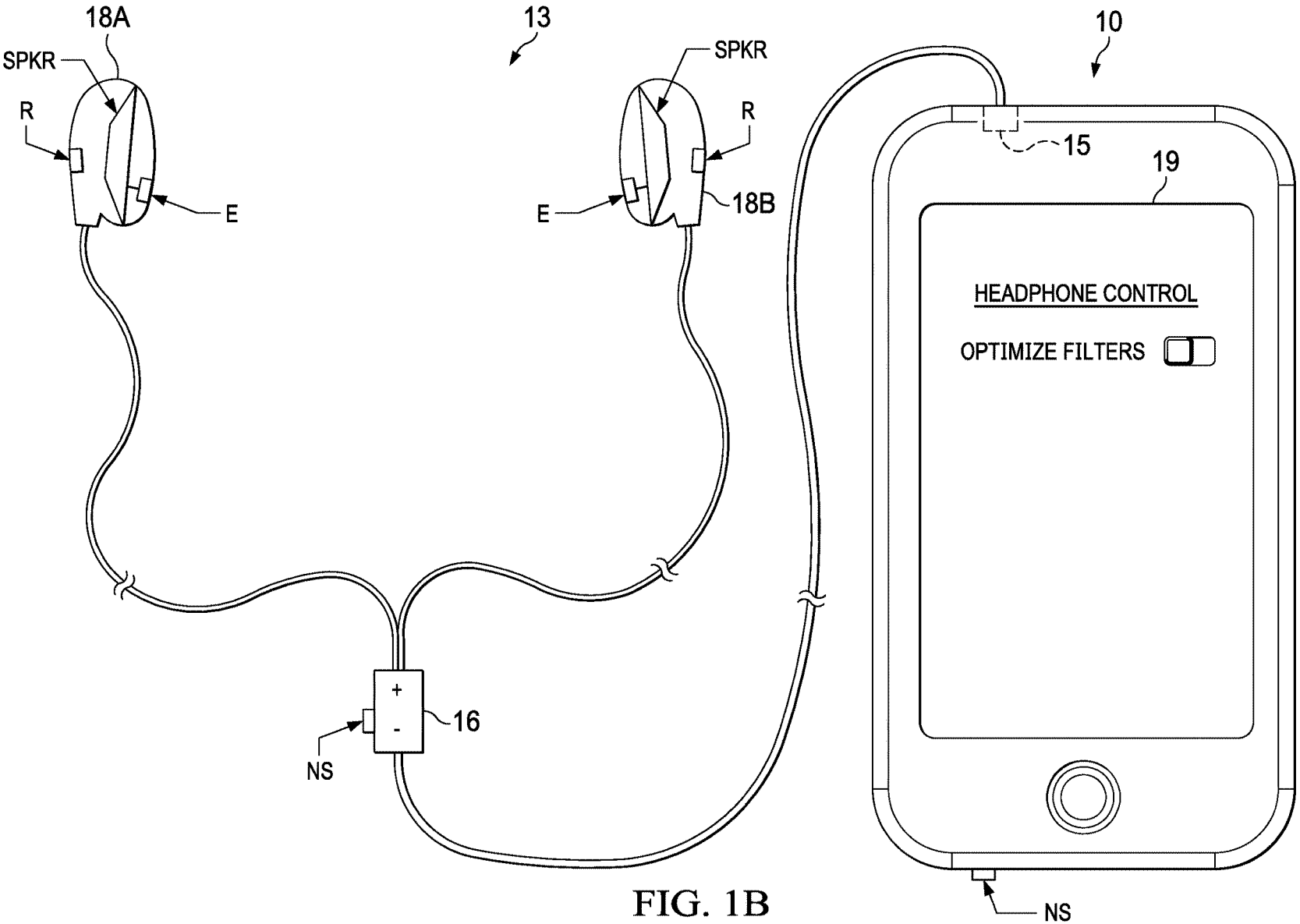
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 (as shown in FIG. 1A but not explicitly shown in FIG. 1B for purposes of clarity of exposition) and/or CODEC IC 20 (as shown in FIG. 1A but not explicitly shown in FIG. 1B for purposes of clarity of exposition). As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and wireless telephone 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R and error microphone E of each headphone and near-speech microphone NS, and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2A:
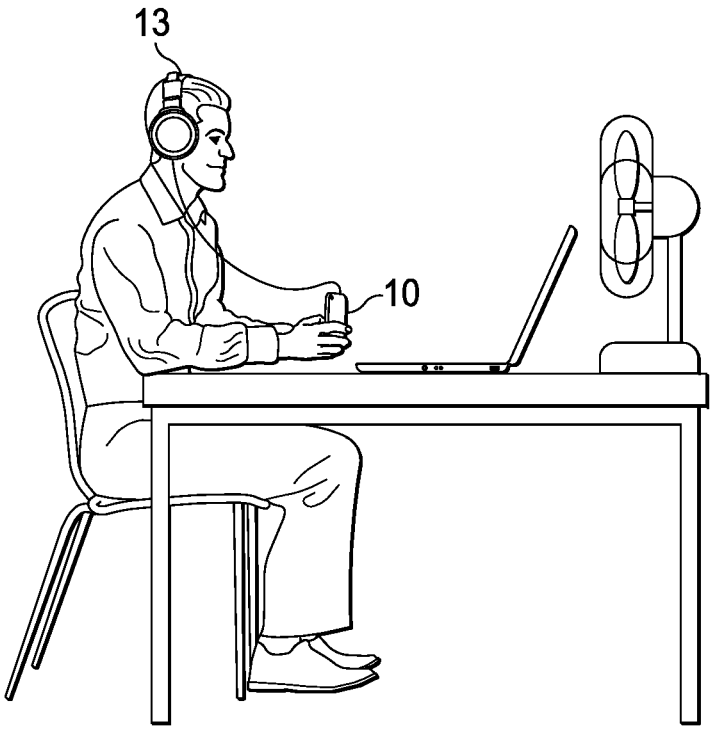
FIG. 2A is an illustration of a user attempting to trigger optimization of adaptive active noise cancelling (ANC), in accordance with embodiments of the present disclosure.
Figure 2B:
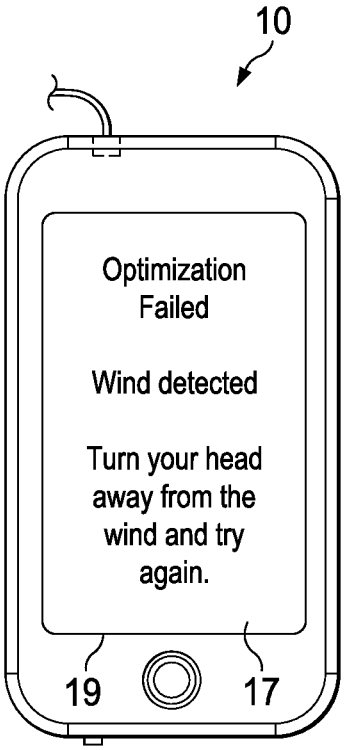
FIG. 2B is an illustration of an alert that may be displayed to a user in response to a user's attempt to trigger optimization of adaptive ANC, in accordance with embodiments of the present disclosure.

In a system such as that depicted in FIG. 1B, a user may want to customize ANC filters to be optimized for how headphone assembly 13 fits in, on, and/or around such user's ear. By pressing a physical or virtual button on headphone assembly 13, combox 16, or a user interface 19 of a mobile phone application, wireless telephone 10 may generate a predetermined training signal. Using the training signal, an ANC system of wireless telephone 10 may adjust parameters to optimize the ANC effect for the user. If the environment is not sufficiently optimal during the training sequence, the mobile application may report the offending event to the user and recommend actions that may be taken to improve the training ability of the system. As an example, as shown in FIG. 2A, the user may try to initiate the training sequence while sitting at an office desk with a small fan blowing on them. If the ANC system determines there is excessive turbulent noise from the wind, as shown in FIG. 2B, an alert 17 to the user may display on user interface 19 that training has failed due to wind noise and/or may encourage the user to turn his or her head away from the wind prior to retraining.

Figure 3:
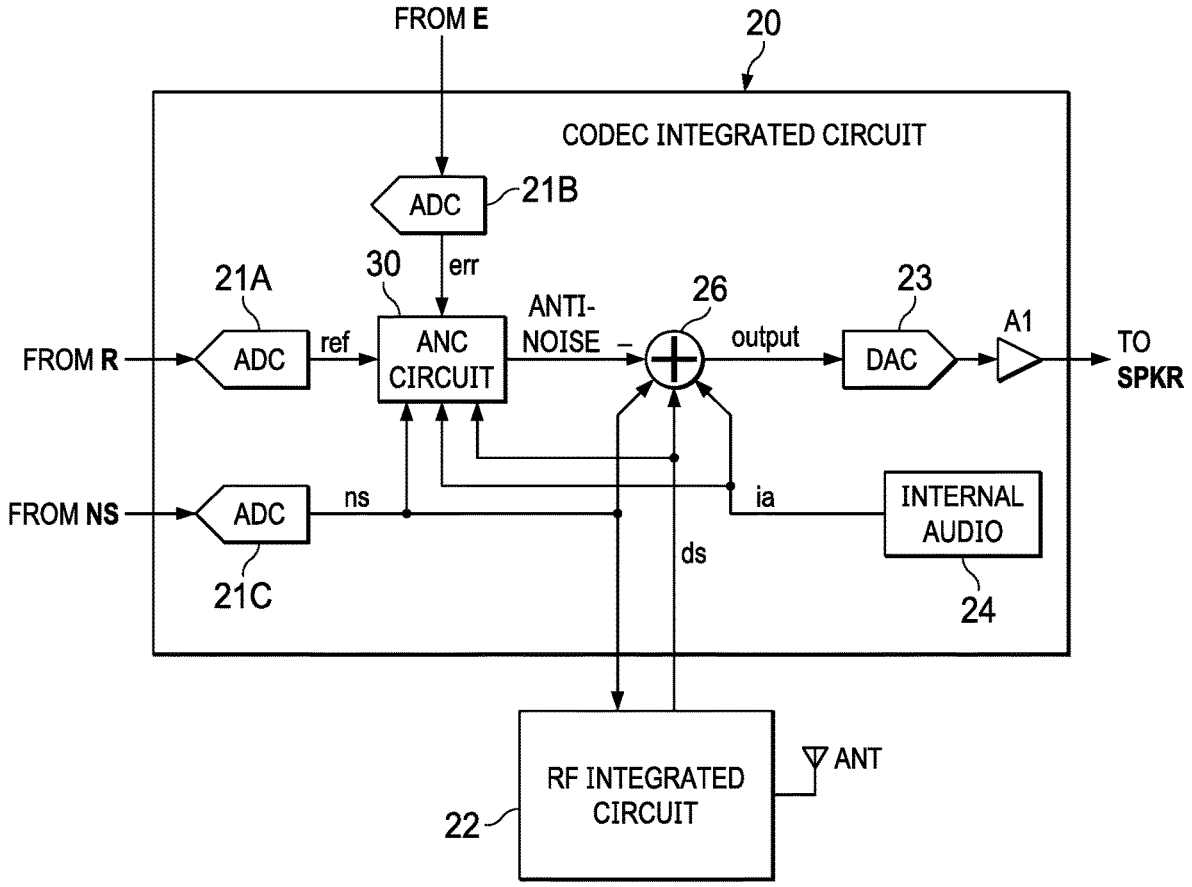
FIG. 3 is a block diagram of selected circuits within the wireless mobile telephone depicted in FIGS. 1A and 1B, in accordance with embodiments of the present disclosure.

Referring now to FIG. 3, selected circuits within wireless telephone 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from error microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 4:
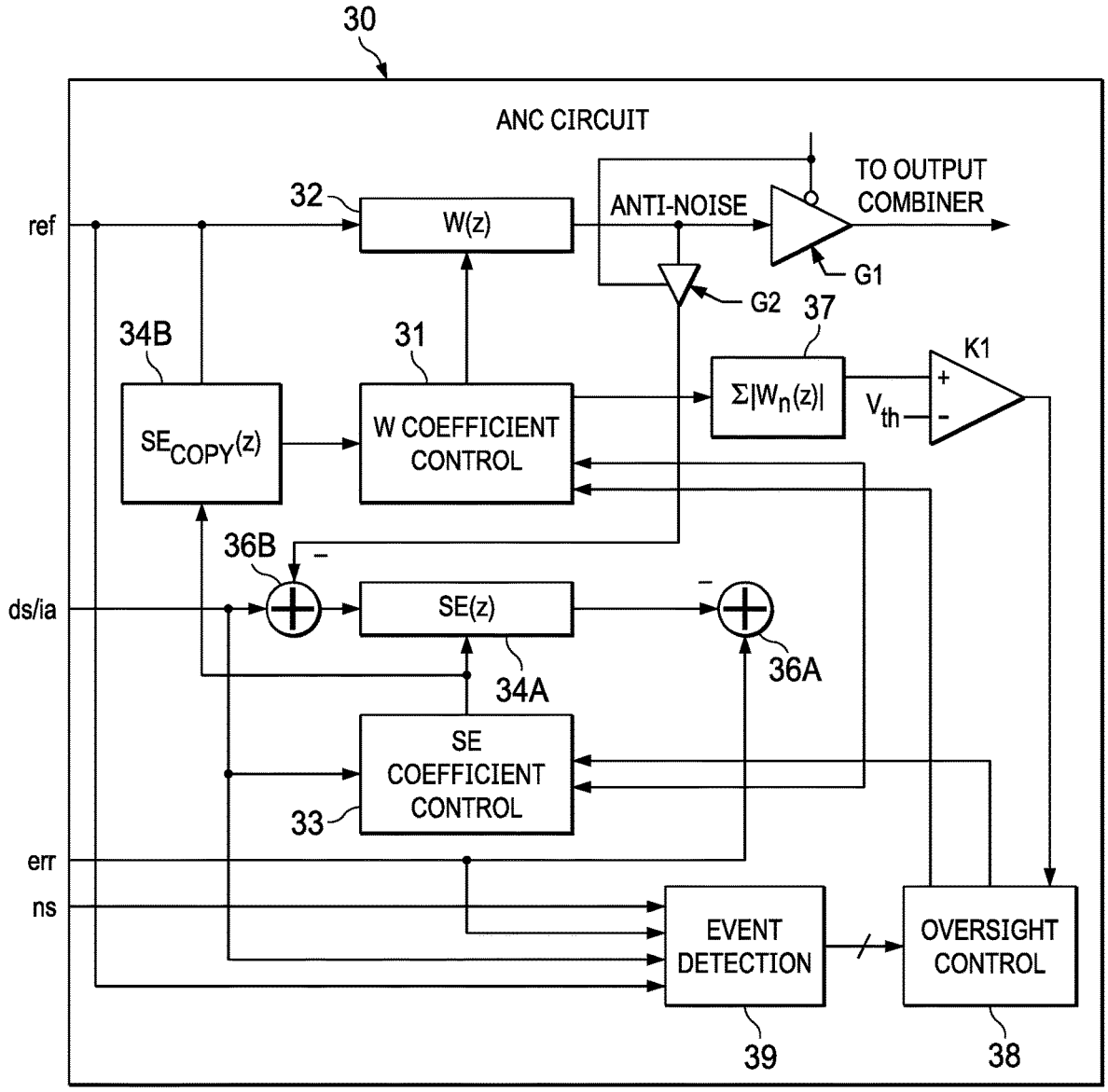
FIG. 4 is a block diagram depicting selected signal processing circuits and functional blocks within an example adaptive noise cancelling (ANC) circuit of a coder-decoder (CODEC) integrated circuit of FIG. 3 which uses feedforward filtering to generate an anti-noise signal, in accordance with embodiments of the present disclosure.

Referring now to FIG. 4, details of ANC circuit 30 are shown in accordance with embodiments of the present disclosure. An adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by speaker SPKR, as exemplified by combiner 26 of FIG. 3. A muting gate circuit G1 may mute the anti-noise signal under certain conditions as described in further detail below, when the anti-noise signal is expected to be erroneous or ineffective. In accordance with some embodiments of the disclosure, another gate circuit G2 may control re-direction of the anti-noise signal into a combiner 36B that provides an input signal to secondary path adaptive filter 34A, permitting W(z) to continue to adapt while the anti-noise signal is muted during certain ambient acoustic conditions as described below. The coefficients of adaptive filter 32 may be controlled by a W coefficient control block 31 that uses a correlation of two signals to determine the response of adaptive filter 32, which may generally minimize the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), SEcopy(z), and minimizing the difference between the resultant signal and error microphone signal err, adaptive filter 32 may adapt to the desired response of P(z)/S(z). In addition to error microphone signal err, the signal compared to the output of filter 34B by W coefficient control block 31 may include an inverted amount of downlink audio/internal audio signal ds+ia (which may also be referred to individually or collectively as "source audio signal") that has been processed by filter response SE(z), of which response SEcopy(z) is a copy. By injecting an inverted amount of downlink audio/internal audio signal ds+ia, adaptive filter 32 may be prevented from adapting to the relatively large amount of downlink audio present in error microphone signal err, and by transforming that inverted copy of downlink audio/internal audio signal ds+ia with the estimate of the response of path S(z), the downlink audio/internal audio that is removed from error microphone signal err before comparison should match the expected version of downlink audio/internal audio signal ds+ia reproduced at error microphone signal err, because the electrical and acoustical path of S(z) is the path taken by downlink audio/internal audio signal ds+ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio/internal audio signal ds+ia and error microphone signal err after removal of the above-described filtered downlink audio/internal audio signal ds+ia, that has been filtered by adaptive filter 34A to represent the expected downlink audio delivered to error microphone E, and which may be removed from the output of adaptive filter 34A by a combiner 36A. SE coefficient control block 33 may correlate the actual downlink audio/internal audio signal ds+ia with the components of downlink audio/internal audio signal ds+ia that are present in error microphone signal err. Adaptive filter 34A may thereby be adapted to generate a signal from downlink audio/internal audio signal ds+ia (and optionally, the anti-noise signal combined by combiner 36B during muting conditions as described above), that when subtracted from error microphone signal err, comprises the content of error microphone signal err that is not due to downlink audio/internal audio signal ds+ia. Event detection 39 and oversight control logic 38 may perform various actions in response to various events in conformity with various embodiments of the disclosure, as will be disclosed in further detail below.

Table 1 below depicts a list of ambient audio events or conditions that may occur in the environment of wireless telephone 10 of FIGS. 1A and 1B, the issues that arise with ANC operation, and example responses that may be taken by ANC processing circuits when the particular ambient events or conditions are detected.

TABLE I

| Type of Ambient Audio Condition or Event | Cause | Issue | Response |
|---|---|---|---|
| Mechanical Noise at Microphone or instability of the coefficients of W(z) in general | Wind, Scratching, etc. | Unstable anti-noise, ineffective cancelation | Mute anti-noise<br>Stop adapt W(z)<br>Reset W(z)<br>Optional 1:<br>Stop adapt SE(z)<br>Reset/Backtrack SE(z)<br>Alternative:<br>Mute anti-noise<br>Redirect anti-noise into SE(z) |
| Howling | Positive feedback caused by increased acoustic coupling between transducer and reference microphone | Anti-noise generates undesirable tone | Mute anti-noise<br>Stop adapt W(z)<br>Stop adapt SE(z)<br>Reset W(z)<br>Optional:<br>Reset/Backtrack SE(z) |
| Overloading noise | SPL too high | Clipping of signals in ANC circuit or transducer can't produce enough output to cancel | Stop adapt W(z)<br>Optionally mute anti-noise<br>Optional:<br>stop adapting SE(s)<br>reset/backtrack SE(z) |
| Silence | Quiet Environment | No reason to ANC, nothing to adapt to. | Stop adapt W(z)<br>Optionally mute anti-noise |
| Tone | Multiple | Disrupts response of W(z) | Stop adapt W(z) |
| Near-end speech | User talking | Don't want to train to cancel near end speech | Stop adapt W(z) or increase leakage |
| Source audio too low | Downlink audio silent, or playback of media stops | Insufficient level to train SE(z) | Stop adapt SE(z) |

As illustrated in FIG. 4, W coefficient control block 31 may provide filter coefficient information to a computation block 37 that computes a time derivative of the sum $\Sigma|W_n(z)|$ of the magnitudes of the filter coefficients $W_n(z)$ that shape the response of adaptive filter 32, which is an indication of the variation overall gain of the response of adaptive filter 32. Large variations in sum $\Sigma|W_n(z)|$ may indicate that mechanical noise such as that produced by wind incident on reference microphone R or varying mechanical contact (e.g., scratching) on the housing of wireless telephone 10, or other conditions such as an adaptation step size that is too large and causes unstable operation has been used in the system. A comparator K1 may compare the time derivative of sum $\Sigma|W_n(z)|$ to a threshold $V_{th}$ to provide an indication to oversight control 38 of a mechanical noise condition, which may be qualified with a detection by event detection 39, whether there are large changes in the energy of near-end speech signal ns that could indicate that the variation in sum $\Sigma|W_n(z)|$ is due to variation in the energy of near-end speech present at wireless telephone 10.

Figure 5:
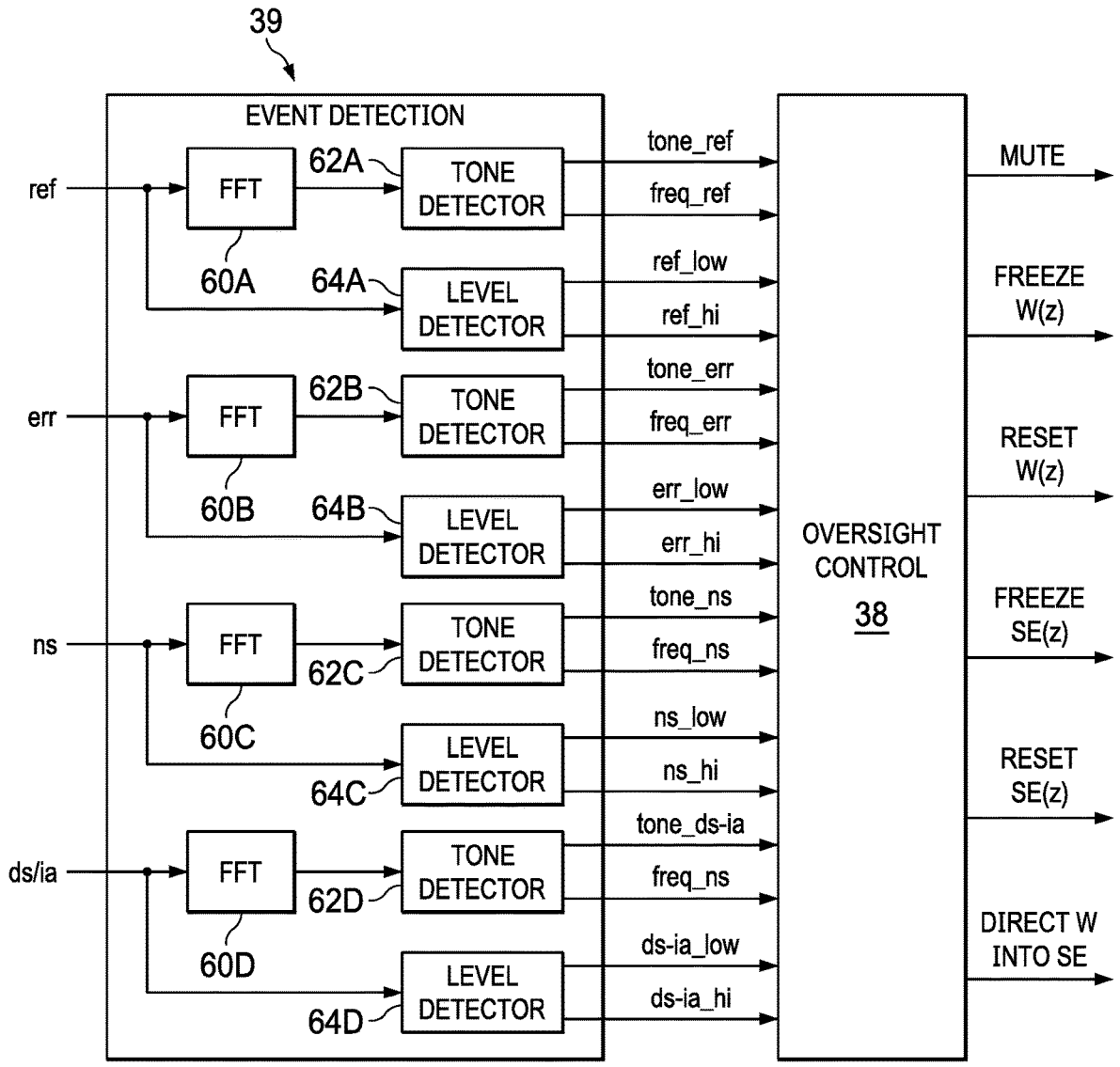
FIG. 5 is a block diagram illustrating functional blocks associated with ambient audio event detection and ANC control in the ANC circuit of FIG. 4, in accordance with embodiments of the present disclosure.

Referring now to FIG. 5, selected details within event detection circuit 39 of FIG. 4 are shown, in accordance with embodiments of the present disclosure. Each of reference microphone signal ref, error microphone signal err, near speech signal ns, and downlink audio/internal audio signal ds+ia may be provided to corresponding Fast Fourier Transform (FFT) processing blocks 60A-60D, respectively. Corresponding tone detectors 62A-62D may receive the outputs from their corresponding FFT processing blocks 60A-60D and generate flags (tone_ref, tone_err, tone_ns and tone_ds−ia) that indicate the presence or absence of a consistent well-defined peak in the spectrum of the input signal that indicates the presence of a tone. Tone detectors 62A-62D may also provide an indication of the frequency of the detected tone (freq_ref, freq_err, freq_ns and freq_ds−ia). Each of reference microphone signal ref, error microphone signal err, near speech signal ns, and downlink audio/internal audio signal ds+ia may also be provided to corresponding level detectors 64A-64D, respectively, that may generate an indication (ref_low, err_low, ns_low, ds−ia_low) when the level of the corresponding input signal level drops below a predetermined lower limit and another indication (ref_hi, err_hi, ns_hi, ds−ia_hi) when the corresponding input signal exceeds a predetermined upper limit. With the information generated by event detector 39, oversight control 38 may determine whether a strong tone is present, including howling due to positive feedback between the transducer and reference microphone R, as may be caused by cupping a hand between the transducer and the reference microphone R, and take appropriate action within the ANC processing circuits. Howling may be detected by determining that a tone is present at each of the microphone inputs (i.e., tone_ref, tone_err and tone_ns are all set), that the frequencies of the tone are all equal (freq_ref=freq_err=freq_ns) and the levels of the bin of the fundamental bin of the tone are greater in error microphone E channel than in the reference microphone R channel and the near speech microphone NS channel ns by corresponding thresholds, and that the err_freq value is not equal to ds−ia_freq, which may indicate that the tone is coming from downlink audio/internal audio signal ds+ia and should be reproduced. Oversight control 38 may also distinguish other types of tones that may be present and take other actions. Oversight control 38 may also monitor the reference microphone signal level indications, ref_low and ref_hi, to determine whether overloading noise is present or the ambient environment is silent, near speech level indication ns_hi, which may indicate that near speech is present, and downlink audio level indication ds−ia_low to determine whether downlink audio is absent. Each of the above-listed conditions may correspond to a row in Table I, and oversight control 38 may take an appropriate action, such as listed in Table I or any other appropriate action, when the particular condition is detected.

By employing event detection 39 and oversight control 38, as described in greater detail below, embodiments of the present disclosure may offer a listener the ability to determine exactly when an ANC system should adapt, by push of a physical or virtual button on the device or by selecting a graphical user interface (GUI) menu item. Such moments for adaptation may be brief, such as a few seconds in length of time. Because the power-costly adaptation may occur only briefly every so often, it may save significant battery life, yet still offer the benefits of adaptation from time to time to provide an optimized ANC experience (that is, desirable antinoise combined with playback audio).

In such an ANC system, which may be referred to as an "Adaptive On Demand" system, unique challenges may be presented. For example, a user may reasonably expect some kind of feedback to acknowledge the request to adapt when the request is triggered upon button push or menu item selection. The desired feedback may be an audibly improved ANC effect, easily distinguished by the listener's ears. Determinations may be made as to what should happen in case ambient events or conditions, as presented in Table 1, are present that would result in undesirable antinoise resulting from misadaptation. Thus, the desired feedback to a user may not be possible under such conditions.

In the case that an audibly improved ANC effect upon a user demand is not possible, as determined by the event detection block 39, the safest recourse for ANC circuit 30 may be to not update the antinoise filter coefficients. The assumption behind this safest recourse may be that the last time the listener updated the antinoise filter, it likely provided some benefit to the listener, therefore it should not be changed for what may likely be a worse antinoise effect. In this case, the listener may hear no change in the antinoise effect, and therefore some kind of alternative feedback to the listener may be desired. Such feedback may be an indication, via either a unique haptic effect on the device or some message at user interface 19, that the request to adapt was received, but that signal conditions did not favor successful adaptation, so adaptation did not in fact occur.

Given the embodiments of the event detection 39 as represented in FIG. 5 for events as listed in Table 1, it may be desirable to inform the user via a message which particular ambient event and/or signal condition(s) were present during their request to adapt which did not favor successful adaptation. Furthermore, it may be desirable to offer some advisory message back to the user as to how the user may avoid the ambient event or signal condition the next time the user requests an Adaptive On Demand training session.

For example, if event detection block 39 determines that wind is present at reference microphone R or near-speech microphone NS when the user makes an Adaptive On Demand training session request, oversight control 38 may prevent adaptation and the antinoise filter coefficients may remain as is. Oversight control 38 may cause an application on wireless telephone 10 to communicate a message to user interface 19 indicating that adaption did not occur due to wind in the background, such as that shown in FIG. 2B (e.g., "Adaptation Did Not Occur due to wind at the headset microphone."). In addition, oversight control 38 may cause an application on wireless telephone 10 to communicate a practical advisory message (alert 17) suggesting what a user may do to allow for successful adaption, as also shown in FIG. 2B (e.g., "Turn your head a little into the wind and request Adaptive On Demand once again."). Such adjustment by a user in response to the suggestion may alleviate the wind present at the microphone so that successful adaptation might proceed.

In the event of a successful Adaptive On Demand session, ANC circuit 30 may save the adapted filter coefficients for one or both of SE(z) adaptive filter 34A and W(z) adaptive filter 32 in a non-volatile memory integral to or otherwise accessible to ANC circuit 30 (e.g., such as shown in described in more detail in below with reference to FIG. 6), so that the next time the user powers off and powers back on headset assembly 13, the most-recent, successfully-adapted coefficients may be reloaded into one or both of adaptive filter 32 and adaptive filter 34A.

In case an Adaptive On Demand request does not result in a successfully adapted antinoise filter, and the antinoise filter remains as is, subsequent, persistent new requests by the listener for Adaptive On Demand, which also fail, may indicate that the current antinoise filter is in fact quite unsatisfactory, and leaving that antinoise filter as is may turn out to not be the best option. In such a case, reverting the antinoise filter to a known, safe fixed-filter coefficient set may be the preferred course. This special situation may be detected in response to multiple consecutive failed Adaptive On Demand training session attempts.

Figure 6:
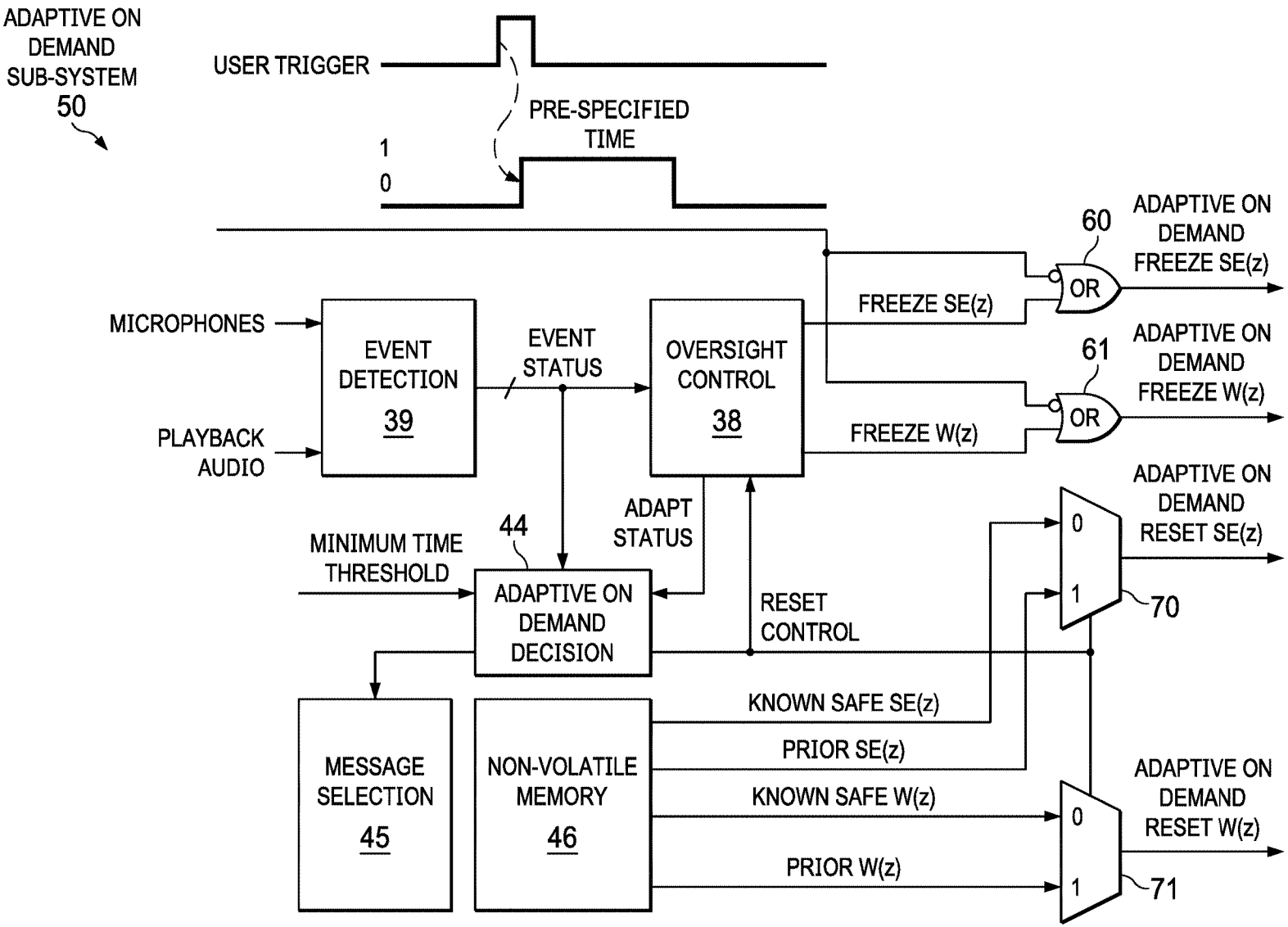
FIG. 6 is a block diagram illustrating an on-demand adaptive ANC subsystem interfaced with an event detection block and an oversight control of the ANC circuit of FIG. 4, in accordance with embodiments of the present disclosure.

FIG. 6 is a block diagram illustrating an on-demand adaptive ANC subsystem 50 interfaced with event detection block 39 and oversight control 38 of ANC circuit 30, in accordance with embodiments of the present disclosure. In some embodiments, on-demand adaptive ANC subsystem 50 may be a part of ANC circuit 30. In operation, event detection block 39 may determine the presence of various ambient events and/or conditions present in the environment of ANC circuit 30. In addition to informing oversight control 38 of such events, event detection block 39 may also inform adaptive on demand decision block 44 of subsystem 50. Adaptive on demand decision block 44 may keep track of such events and/or conditions, and if an Adaptive On Demand attempt happens to fail due to some such event and/or condition, then adaptive on demand decision block 44 may use such event/condition information to communicate an appropriate indication to message selection block 45 of subsystem 50, which may in turn choose an appropriate message to communicate to the user (e.g., via user interface 19) what the result of the Adaptive On Demand attempt was and, if necessary, advise the user how to better avoid a failed session next time they trigger an Adaptive On Demand attempt.

As shown in FIG. 6, adaptive on demand decision block 44 may also receive status information from oversight control 38 whether or not the adaptive filters SE(z) and W(z) actually adapted during the Adaptive On Demand attempt, and if they did happen to adapt during some portion of the brief session, what percentage of time was spent adapting. If the various systems did not spend a significant enough percentage of time adapting, then adaptive on demand decision block 44 may determine the Adaptive On Demand attempt is a failure. The notion of what percentage of time actually constitutes a significant enough amount of time for success or failure may be arrived at by simply comparing the percentage with a programmable Minimum Time Threshold (e.g., if the percentage of time adapted is below the Minimum Time Threshold, then the Adaptive On Demand attempt may be deemed a failure).

Because the adaptive ANC system as embodied by ANC circuit 30 is a continuously adaptive system, the integration of the Adaptive On Demand sub-system may necessarily involve gating off outputs of oversight control 38 so that adaptation is only allowed to occur during a pre-specified brief period of time following the user trigger of an Adaptive On Demand attempt. Such gating of outputs may be implemented using OR gates 60 and 61 as shown in FIG. 6, wherein the adaptive system implemented by ANC circuit 30 may be frozen (thus saving battery power) outside of time intervals in which Adaptive On Demand attempts are being performed.

In case adaptive on demand decision block 44 determines that an Adaptive On Demand attempt is a failure, then the filter coefficients in SE(z) and W(z) may be restored to what they were prior to the Adaptive On Demand attempt. These coefficient sets represent what may likely be the best antinoise experience for the user. Because the listener may power down the headset and wish to restore these coefficients upon powering it back up later, these coefficient sets may be stored in non-volatile memory 46.

If it so happens that the listener initiates an Adaptive on Demand attempt that results in a failure (and is informed as such), then immediately thereafter initiates another such session that also fails, and possibly even initiates a third such session, which also fails, then it is likely that the listener is not satisfied with the prior coefficient sets for responses SE(z) and/or W(z). In that case, adaptive on demand decision block 44 may sense this situation and instead of restoring prior coefficient sets from non-volatile memory 46, it may instead reset these filters to known, safe coefficient sets, determined prior to product launch or latest manufacturer update, which may also be stored in non-volatile memory 46. This functionality may be implemented using multiplexers 70 and 71 depicted in FIG. 6.

Figure 7:
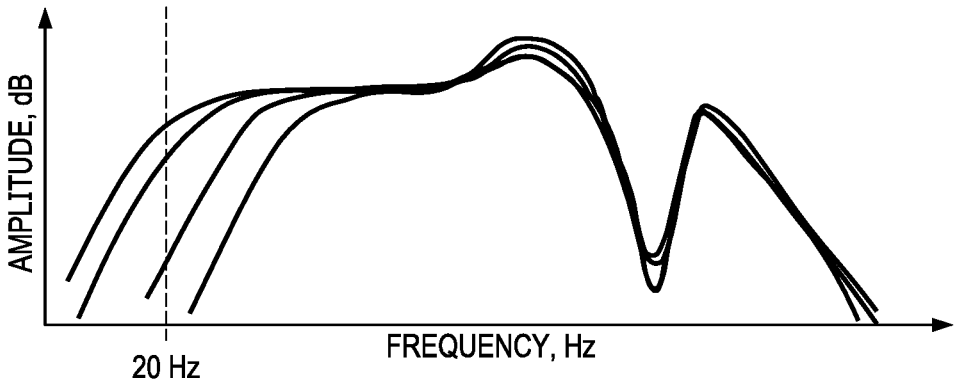
FIG. 7 depicts a plurality of curves of amplitude versus frequency for different fits of a speaker to a user's ear, in accordance with embodiments of the present disclosure.

In some instances, it may be desirable to prompt a user to initiate an Adaptive On Demand attempt. To illustrate, at very low frequencies, a speaker-to-ear frequency response may change dramatically depending on a fit of a speaker to the listener's ear. For example, FIG. 7 depicts a plurality of curves of amplitude versus frequency for different fits of a speaker to a user's ear, in accordance with embodiments of the present disclosure. As shown in FIG. 7, the amplitude-versus-frequency response among speaker-to-ear fits changes the most at low frequencies. This feature may be exploited to determine that the headset fit has changed since the last successful Adaptive On Demand attempt. Because adaptive ANC effect of ANC circuit 30 may be highly dependent on speaker-to-ear coupling, and because most real-world ambient noises are broadband enough in spectral content to adequately train the adaptive ANC system for a wide variety of ambient noise types when initiated under favorable conditions, the most likely reason for a reduction of ANC effect after training is that the fit of the headset on the ear has changed. Therefore, if the ANC circuit 30 determines that the fit has changed since the last successful Adaptive On Demand attempt, then the listener may be prompted at that time to re-initiate another Adaptive On Demand attempt. Initiation of the new Adaptive On Demand session, if successful, may adapt the antinoise to the new speaker-to-ear coupling, resulting in an improved ANC experience for the listener.

Figure 8:
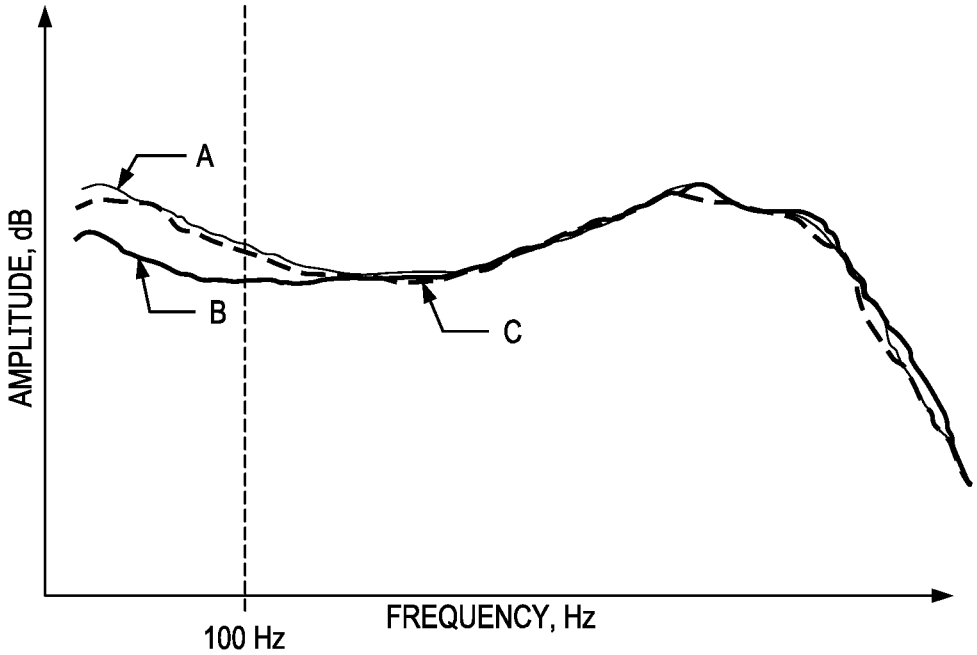
FIG. 8 depicts a plurality of curves of amplitude versus frequency of playback audio for different fits of an over-ear headset speaker to a user's ear, in accordance with embodiments of the present disclosure.

The speaker-to-ear frequency response changes due to fit may also introduce variations in the playback response for the user. As shown in FIG. 7, low frequencies are especially sensitive to fit variations and may color the playback response heard by the user. To further illustrate, FIG. 8 depicts a plurality of curves of amplitude versus frequency of playback audio for different fits of an over-ear headset speaker to a user's ear, in accordance with embodiments of the present disclosure. Curve A represents a standard fit and Curve B represents a response while the user is wearing eyeglasses. Multiple playback equalization curves may be stored in non-volatile memory 46 and be made available to replace an existing curve if the system detects a change in headset to ear coupling. The approach described above may determine the amount that the fit has changed since the last successful Adaptive On Demand attempt or from factory default settings, and then may prompt a user to initiate a playback equalization curve modification to improve their listening experience based on headset fit (e.g., Curve C as shown in FIG. 8). The user then may optionally trigger this change by some action such as a button press or voice command, and subsystem 50 may select the most appropriate stored curve based on speaker-to-ear coupling to replace the current curve. In some embodiments, such prompting may be accomplished with a haptic feedback effect on the device, or perhaps some audible effect played through the headset speaker.

Figure 9:
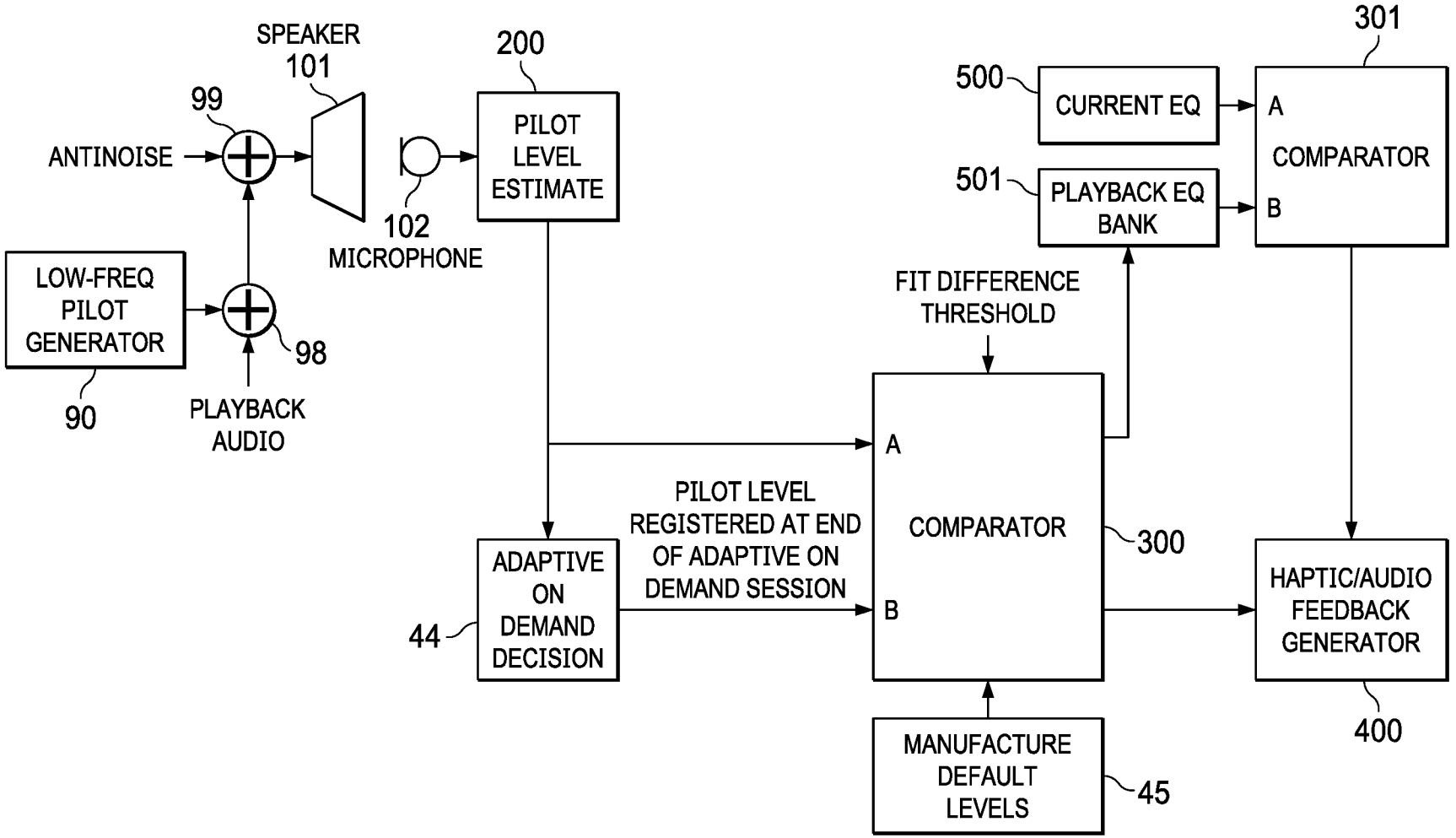
FIG. 9 is a block diagram illustrating a prompting subsystem for an on- demand adaptive ANC subsystem, in accordance with embodiments of the present disclosure.

FIG. 9 is a block diagram illustrating a prompting subsystem for an on-demand adaptive ANC subsystem, in accordance with embodiments of the present disclosure. In such prompting subsystem, a low-frequency pilot generator 90 may inject, via summer 98, an inaudible pilot signal, for example a 20 Hz tone, into playback audio. This combined audio signal may be added to the antinoise via summer 99 and played out of headset speaker 101. The coupling between the speaker 101 and the microphone 102 may be a function of the speaker-to-ear fit. A pilot level estimate 200 may continuously determine how strong or weak in level or amplitude the pilot signal is at any time. Adaptive on demand decision block 44 may save the level of the pilot determined during the last successful training session, or the manufacturer default levels of block 45 if no previous Adaptive On Demand attempt has been successful. This pilot level may be compared in comparator 300 to the current pilot level, and if the absolute difference is greater than some programmable fit difference threshold for ANC, then a haptic/audio feedback generator block 400 may provide some prompt to the user. In a similar manner, the pilot level may be compared by comparator 300 to block 44 or 45, and if the absolute difference is greater than one or several programmable fit difference thresholds for equalizer (EQ) selection, a corresponding EQ response may be selected from a playback EQ bank 501. Selected EQ 501 and the current EQ 500 may be compared by a comparator 301, and if the absolute difference is greater than 0, then haptic/audio feedback generator block 400 may provide some prompt to the listener. To avoid a constant stream of undesireable prompts, haptic/audio feedback generator block 400 may sense how many times it has prompted the listener without the listener having taken action on the prompt, and schedule less-frequent, or perhaps lower amplitude prompts.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. An integrated circuit for implementing at least a portion of a personal audio device, comprising:

an output for providing a signal to a transducer including both a source audio signal for playback to a listener and an anti-noise signal for countering the effects of ambient audio sounds in an acoustic output of the transducer;

a user trigger input for receiving a user trigger signal indicating a user desire to update characteristics of an adaptive filter;

an error microphone input for receiving an error microphone signal indicative of the output of the transducer and the ambient audio sounds at the transducer; and a processing circuit configured to:

implement the adaptive filter having a response that generates the anti-noise signal to reduce the presence of the ambient audio sounds in the error microphone signal;

responsive to receiving the user trigger signal, determine if undesirable ambient conditions exist such that updating characteristics of the adaptive filter in the presence of the undesirable ambient conditions would lead to the anti-noise signal having undesirable characteristics;

responsive to determining a presence of undesirable ambient conditions such that updating characteristics of the adaptive filter in the presence of the undesirable ambient conditions would lead to the anti-noise signal having undesirable characteristics, prevent updating characteristics of the adaptive filter; and responsive to determining an absence of the undesirable ambient conditions, update characteristics of the adaptive filter.

2. The integrated circuit of claim 1, wherein the processing circuit is further configured to communicate an indication to a user of the presence of undesirable ambient conditions such that updating characteristics of the adaptive filter in the presence of the undesirable ambient conditions would lead to the anti-noise signal having undesirable characteristics.

3. The integrated circuit of claim 2, wherein the indication identifies the undesirable ambient conditions present.

4. The integrated circuit of claim 3, wherein the processing circuit is further configured to communicate a recommendation to the user as to how to reduce the undesirable ambient conditions in order to provide ambient conditions under which characteristics of the adaptive filter may be updated.

5. The integrated circuit of claim 1, wherein the processing circuit is configured to, when updating characteristics of the adaptive filter, save the characteristics to a non-volatile memory accessible to the processing circuit to enable subsequent retrieval and application of the characteristics to the adaptive filter.

6. The integrated circuit of claim 1, wherein the processing circuit is further configured to implement a coefficient control block that shapes the response of the adaptive filter in conformity with the error microphone signal by computing coefficients that determine the response of the adaptive filter to minimize the ambient audio sounds in the error microphone signal, wherein the characteristics comprise the coefficients.

7. The integrated circuit of claim 1, wherein the adaptive filter comprises a feedback filter that generates at least a portion of the anti-noise signal by applying the response of the adaptive filter to the error microphone signal.

8. The integrated circuit of claim 1, wherein the adaptive filter comprises a secondary path estimate filter configured to model an electro-acoustic path of the source audio signal and have a response that generates a secondary path estimate from the source audio signal.

9. The integrated circuit of claim 8, wherein the processing circuit further implements a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

10. The integrated circuit of claim 8, wherein:

the undesirable ambient conditions comprise a non-favorable condition for the source audio signal; and the processing circuit further implements an equalizer filter applied to the source audio signal and is configured to adjust the equalizer filter to affect the source audio signal to minimize effects of the non-favorable condition.

11. The integrated circuit of claim 10, wherein the non-favorable condition for the source audio signal comprises a non-optimal auditory coupling of the transducer to an ear of the user.

12. The integrated circuit of claim 1, wherein:

the integrated circuit further comprises a reference microphone input for receiving a reference microphone signal indicative of the ambient audio sounds; and the adaptive filter comprises a feedforward filter having a response that generates the anti- noise signal from the reference signal to reduce the presence of the ambient audio sounds heard by the listener.

13. The integrated circuit of claim 12, wherein the processing circuit further implements a feedforward coefficient control block that shapes the response of the adaptive filter in conformity with the error microphone signal and the reference microphone signal to minimize the ambient audio sounds at the error microphone.

14. The integrated circuit of claim 1, wherein the undesirable ambient condition comprises one or more of wind noise, scratching on a housing of a personal audio device including the integrated circuit, a substantially tonal ambient sound, a divergence of coefficients of the adaptive filter, a signal level falling outside of a predetermined range for such signal level, and an excessive increase in a magnitude of coefficients of the adaptive filter.

15. A method comprising:

receiving a user trigger signal indicating a user desire to update characteristics of an adaptive filter;

receiving an error microphone signal indicative of the output of a transducer and the ambient audio sounds at the transducer, wherein the transducer reproduces both a source audio signal for playback to a listener and an anti-noise signal for countering the effects of ambient audio sounds in an acoustic output of the transducer;

implementing the adaptive filter having a response that generates the anti-noise signal to reduce the presence of the ambient audio sounds in the error microphone signal;

responsive to receiving the user trigger signal, determining if undesirable ambient conditions exist such that updating characteristics of the adaptive filter in the presence of the undesirable ambient conditions would lead to the anti-noise signal having undesirable characteristics;

responsive to determining a presence of undesirable ambient conditions such that updating characteristics of the adaptive filter in the presence of the undesirable ambient conditions would lead to the anti-noise signal having undesirable characteristics, preventing updating characteristics of the adaptive filter; and responsive to determining an absence of the undesirable ambient conditions, updating characteristics of the adaptive filter.

16. The method of claim 15, further comprising communicating an indication to a user of the presence of undesirable ambient conditions such that updating characteristics of the adaptive filter in the presence of the undesirable ambient conditions would lead to the anti-noise signal having undesirable characteristics.

17. The method of claim 16, wherein the indication identifies the undesirable ambient conditions present.

18. The method of claim 17, further comprising communicating a recommendation to the user as to how to reduce the undesirable ambient conditions in order to provide ambient conditions under which characteristics of the adaptive filter may be updated.

19. The method of claim 15, further comprising, when updating characteristics of the adaptive filter, saving the characteristics to a non-volatile memory accessible to the processing circuit to enable subsequent retrieval and application of the characteristics to the adaptive filter.

20. The method of claim 15, further comprising implementing a coefficient control block that shapes the response of the adaptive filter in conformity with the error microphone signal by computing coefficients that determine the response of the adaptive filter to minimize the ambient audio sounds in the error microphone signal, wherein the characteristics comprise the coefficients.

21. The method of claim 15, wherein the adaptive filter comprises a feedback filter that generates at least a portion of the anti-noise signal by applying the response of the adaptive filter to the error microphone signal.

22. The method of claim 15, wherein the adaptive filter comprises a secondary path estimate filter configured to model an electro-acoustic path of the source audio signal and have a response that generates a secondary path estimate from the source audio signal.

23. The method of claim 22, further comprising implementing a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

24. The method of claim 22, wherein:

the undesirable ambient conditions comprise a non-favorable condition for the source audio signal; and the method further comprises implementing an equalizer filter applied to the source audio signal and is configured to adjust the equalizer filter to affect the source audio signal to minimize effects of the non-favorable condition.

25. The method of claim 24, wherein the non-favorable condition for the source audio signal comprises a non-optimal auditory coupling of the transducer to an ear of the user.

26. The method of claim 15, wherein:

the integrated circuit further comprises a reference microphone input for receiving a reference microphone signal indicative of the ambient audio sounds; and the adaptive filter comprises a feedforward filter having a response that generates the anti- noise signal from the reference signal to reduce the presence of the ambient audio sounds heard by the listener.

27. The method of claim 26, further comprising implementing a feedforward coefficient control block that shapes the response of the adaptive filter in conformity with the error microphone signal and the reference microphone signal to minimize the ambient audio sounds at the error microphone.

28. The method of claim 15, wherein the undesirable ambient condition comprises one or more of wind noise, scratching on a housing of a personal audio device including the integrated circuit, a substantially tonal ambient sound, a divergence of coefficients of the adaptive filter, a signal level falling outside of a predetermined range for such signal level, and an excessive increase in a magnitude of coefficients of the adaptive filter.

* * * * *